US009377197B2

(12) United States Patent
El Masalme et al.

(10) Patent No.: US 9,377,197 B2
(45) Date of Patent: Jun. 28, 2016

(54) GAS TURBINE COMBUSTION CHAMBER

(75) Inventors: Jaman El Masalme, Hamminkeln (DE); Emil Aschenbruck, Duisburg (DE); Reiner Brinkmann, Duisburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 1106 days.

(21) Appl. No.: 13/387,905

(22) PCT Filed: Jul. 20, 2010

(86) PCT No.: PCT/DE2010/050048

§ 371 (c)(1),
(2), (4) Date: Mar. 1, 2012

(87) PCT Pub. No.: WO2011/012126

PCT Pub. Date: Feb. 3, 2011

(65) Prior Publication Data

US 2012/0144834 A1 Jun. 14, 2012

(30) Foreign Application Priority Data

Jul. 31, 2009 (DE) ..... 10 2009 035 550

(51) Int. Cl.

| | |
|---|---|
| ***F23R 3/02*** | (2006.01) |
| ***F23R 3/04*** | (2006.01) |
| ***F23R 3/60*** | (2006.01) |
| ***F23R 3/00*** | (2006.01) |

(52) U.S. Cl.

CPC . *F23R 3/002* (2013.01); *F23R 3/04* (2013.01); *F23R 3/60* (2013.01); *F23R 2900/03044* (2013.01)

(58) Field of Classification Search

CPC ..... F02C 3/145; F02C 7/20; F05D 2240/90; F05D 2240/91; F05D 2260/30; F23R 3/002; F23R 3/04; F23R 3/06; F23R 3/44; F23R 3/46; F23R 3/54; F23R 3/60; F23R 2900/00017; F23R 2900/03342

See application file for complete search history.

(56) References Cited

U.S. PATENT DOCUMENTS

| | | | | | |
|---|---|---|---|---|---|
| 3,777,484 | A * | 12/1973 | Dibelius | F23R 3/002 | 60/757 |
| 4,567,730 | A * | 2/1986 | Scott | 60/757 | |
| 4,872,312 | A * | 10/1989 | Iizuka | F01D 9/023 | 60/754 |
| 5,291,732 | A * | 3/1994 | Halila | 60/796 | |
| 5,457,954 | A * | 10/1995 | Boyd et al. | 60/800 | |
| 5,784,876 | A | 7/1998 | Alkabie | | |
| 6,134,877 | A * | 10/2000 | Alkabie | 60/800 | |
| 6,826,913 | B2 * | 12/2004 | Wright | F23R 3/005 | 60/752 |
| 2007/0031188 | A1 * | 2/2007 | Glessner et al. | 403/348 | |
| 2009/0120094 | A1 * | 5/2009 | Norster | F23R 3/002 | 60/752 |
| 2010/0225902 | A1 * | 9/2010 | Bagley et al. | 356/237.1 | |

FOREIGN PATENT DOCUMENTS

| | | |
|---|---|---|
| DE | 197 51 299 | 6/1999 |
| DE | 602 16 180 | 9/2007 |
| EP | 1 524 471 | 4/2005 |
| JP | S57-154857 | 9/1982 |
| JP | 58-210413 | 12/1983 |
| JP | 2002-162036 | 6/2002 |
| JP | 2003-176728 | 6/2003 |
| WO | WO 03/042597 | 5/2003 |
| WO | WO2008/028621 A1 | 3/2008 |

* cited by examiner

*Primary Examiner* — Andrew Nguyen
(74) *Attorney, Agent, or Firm* — Cozen O'Connor

(57) ABSTRACT

A gas turbine combustion chamber has a housing (1), a flame tube (2) received therein, and a perforated plate (3) which at least partially surrounds the latter and which is fastened at both of its end faces (3.1, 3.2) to the housing.

11 Claims, 2 Drawing Sheets

GAS TURBINE COMBUSTION CHAMBER

PRIORITY CLAIM

This is a U.S. national stage of application No. PCT/DE2010/050048, filed on 20 Jul. 2010. Priority is claimed on the following application(s): Country: Germany, Application No.: 10 2009 035 550.2, Filed: 31 Jul. 2009 the content of which is incorporated herein by reference.

FIELD OF THE INVENTION

The present invention is directed to a gas turbine combustion chamber having a housing, a flame tube received therein, and a perforated plate surrounding the latter and which is fastened at an end face to the housing, and a gas turbine, particularly a stationary gas turbine, having a gas turbine combustion chamber of this type.

BACKGROUND OF THE INVENTION

In a gas turbine, a fluid, generally air and therefore designated in the following broadly as combustion air, is initially compressed to a higher pressure level and burned as a combustion air/fuel mixture in a combustion chamber before enthalpy of the exhaust gas is converted into mechanical energy in a turbine and made available as useful power.

In so doing, the combustion chamber undergoes high compressive loading and high temperature loading due to the pressure level and the combustion. Therefore, it was common in the prior art heretofore to strengthen the housing of the combustion chamber by means of inner and/or outer stiffening ribs, to use high-temperature materials, and to provide a flame tube in the housing which limits the combustion zone and thus shields the housing at least partially against the combustion heat.

Besides ceramic temperature protection layers and film cooling, impingement cooling of the flame tube is known, for example, from WO 2008/028621 A1. A perforated plate surrounding the flame tube is provided for this purpose. Compressed combustion air impinges on the flame tube from the outside through apertures in the perforated plate and cools the flame tube before being fed through a radial swirler to the interior of the flame tube and combustion chamber and burned therein.

U.S. Pat. No. 6,134,877 discloses a gas turbine combustion chamber having a housing, a flame tube received therein, and a conically shaped cylinder which surrounds the flame tube and which has openings in a downstream area for impingement cooling of a flame tube region of decreasing diameter and which is fastened at an end face to the housing. An axial flexibility of the cylinder is introduced by means of a convoluted region to enable thermal expansions. The other end of the cylinder opens into the turbine outlet.

Particularly in stationary gas turbines having freestanding combustion chambers on the radially outer side, as is shown in FIG. 1, the additional weight of the stiffening ribs 110 shown in FIG. 1 poses a problem because it impedes handling of the separate combustion chambers and loads their connection to the housing of the turbine with torque that must be supported.

Therefore, it is an object of the present invention to improve a gas turbine and the combustion chambers thereof.

SUMMARY OF THE INVENTION

The present invention is directed to a gas turbine combustion chamber having a housing, a flame tube received therein and a perforated plate at least partially surrounding the flame tube. Both end faces of the flame tube are fastened to the housing. A gas turbine having at least one gas turbine combustion chamber according to the invention is also disclosed.

The idea upon which the present invention is based is to reduce or replace stiffening ribs which were formerly required in the housing by incorporating or integrating the perforated plate in the housing structure on both sides as a supporting structure and so increasing the structural stiffness and/or strength of the housing.

The gas turbine combustion chamber according to the present invention comprises a housing, a flame tube received therein, and a perforated plate which at least partially surrounds the latter and which is fastened at both end faces to the housing. In this way, the perforated plate can transmit in particular axial loads between both end faces thereof and introduce them into the housing, which is accordingly relieved of loading.

The strength and/or stiffness of the housing can be increased without increasing its weight through excessive inner ribs or outer ribs in that the perforated plate is used not only for conducting flow and for cooling but, according to the invention, also to transmit loads of the housing and for this purpose is connected to the housing at both sides.

As stated above, it is particularly advantageous when the gas turbine combustion chamber is constructed as separate combustion chamber located radially on the outer side and whose housing accordingly forms an outer housing of one or more parts with respect to the gas turbine environment.

In a preferred embodiment, the perforated plate has cooling apertures, particularly bore holes and/or slot openings, at least in a primary combustion area of the flame tube for impingement cooling of the flame tube. Preferably by means of a suitable arrangement and/or dimensioning of the cooling apertures, for example, an angular offsetting of axially adjacent cooling apertures so that the perforated plate has a net-like structure, or axially aligned cooling apertures so that the perforated plate has axially continuous webs, through slits in axial and/or circumferential direction of the perforated plate and/or by limiting the quantity and/or diameter of the cooling apertures, the stiffness and strength of the perforated plate can be adjusted particularly axially.

Particularly in a primary combustion area of the kind mentioned above, the housing can be formed by an annular chamber for impingement of combustion air on the perforated plate in order to cool preferably this axial portion of the flame tube which is highly loaded thermally. An annular chamber is preferably constructed in such a way that the supplied combustion air is supplied in its entirety to the flame tube through cooling apertures of the perforated plate and, for this purpose, can extend in axial direction preferably substantially in the primary combustion area. The perforated plate can limit or define the annular chamber radially from the inner side and, for this purpose, can extend on one or both sides beyond the annular chamber adjoining it from the outer side. When the areas of the perforated plate extending axially beyond the annular chamber form a part of an outer housing, the annular chamber can be fitted to the perforated plate from the outer side and the perforated plate is accordingly structurally integrated in the outer housing in a particularly advantageous manner as part of the outer housing.

In a preferred embodiment, the perforated plate is nondetachably fastened at one or both end faces to the housing, particularly welded, glued, press-fit stemmed and/or riveted to this housing. In this way, structural loads can be transmitted in a particularly advantageous manner between the housing and perforated plate. Similarly, it is also possible that the perforated plate is detachably fastened to the housing at least at one of its two end faces in order to facilitate assembly (and disassembly) of the gas turbine combustion chamber.

The perforated plate can form a part of the housing. In particular, the perforated plate can have one or more portions which delimit a combustion air supply over the outside environment. Such portions can be constructed of one or more parts with a portion having cooling apertures, in particular primary-formed, shaped or welded together.

In an advantageous embodiment, the housing can be constructed without ribs to a great extent at least in the area of the perforated plate.

According to a preferred embodiment, the gas turbine combustion chamber has a radial swirler with a preferably annular plate which can form a part of a housing, particularly an outer housing, or can be fastened thereto. An end face of the perforated plate can be fastened to the annular plate.

Due to the distribution of structural loads to the housing and integrated perforated plate in accordance with the invention, the housing can advantageously be constructed so as to have a thinner wall. One or more corresponding areas of the housing and perforated plate preferably have substantially the same wall thickness. Corresponding areas are in particular areas at the same axial height of the combustion chamber.

In a preferred embodiment, the flame tube is fastened axially to the housing at an upstream end face of the flame tube. Due to the fact that the perforated plate is connected at both sides, the greater clearance or the greater thermal expansions can occur in an upstream head area of the combustion chamber so that it may now be advantageous to provide the fixed bearing support of a fixed-floating bearing-supported flame tube at that location.

The perforated plate is preferably constructed substantially as a right circular cylinder in order to provide a greater structural stiffness and structural strength.

BRIEF DESCRIPTION OF THE DRAWINGS

Further advantages and features are described in more detail below with reference to the drawings, in which.

DETAILED DESCRIPTION OF THE PREFERRED EMBODIMENTS

Figure 1:
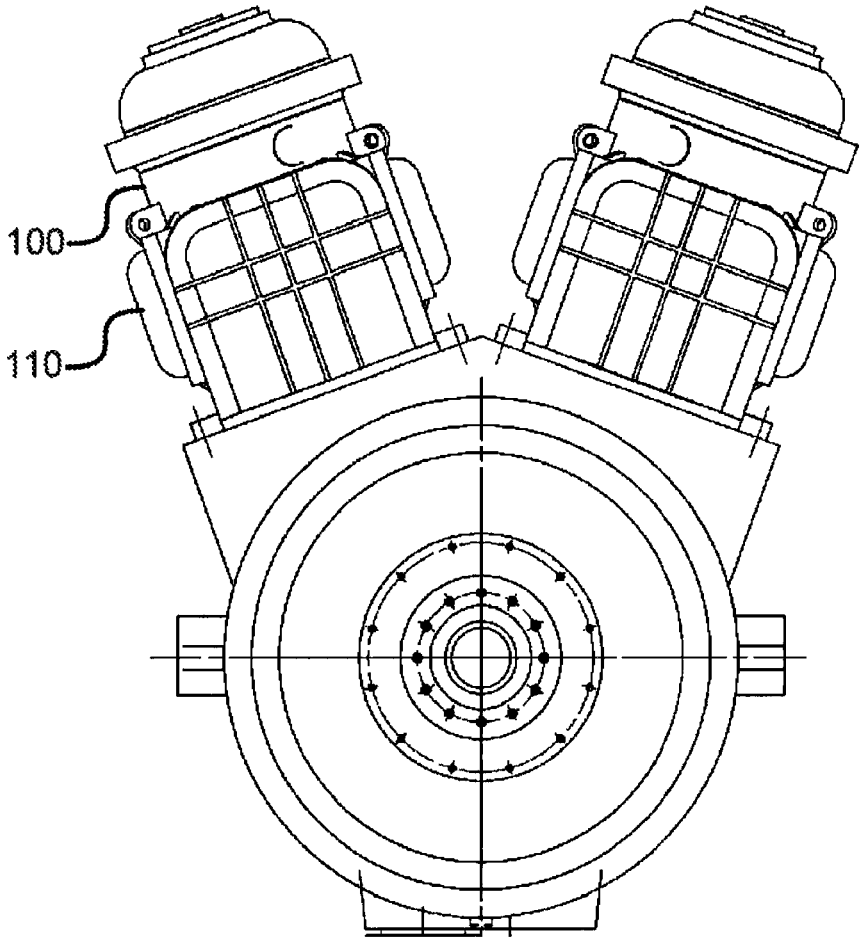
FIG. 1 is a view of a gas turbine according to the prior art having two external combustion chambers.

FIG. 1 shows a gas turbine according to the prior art having two external combustion chambers whose housings 100 are strengthened by stiffening ribs 110 and which accordingly, due to their greater weight, impede handling and load the turbine housing which is located below them and to which they are fastened.

Figure 2:
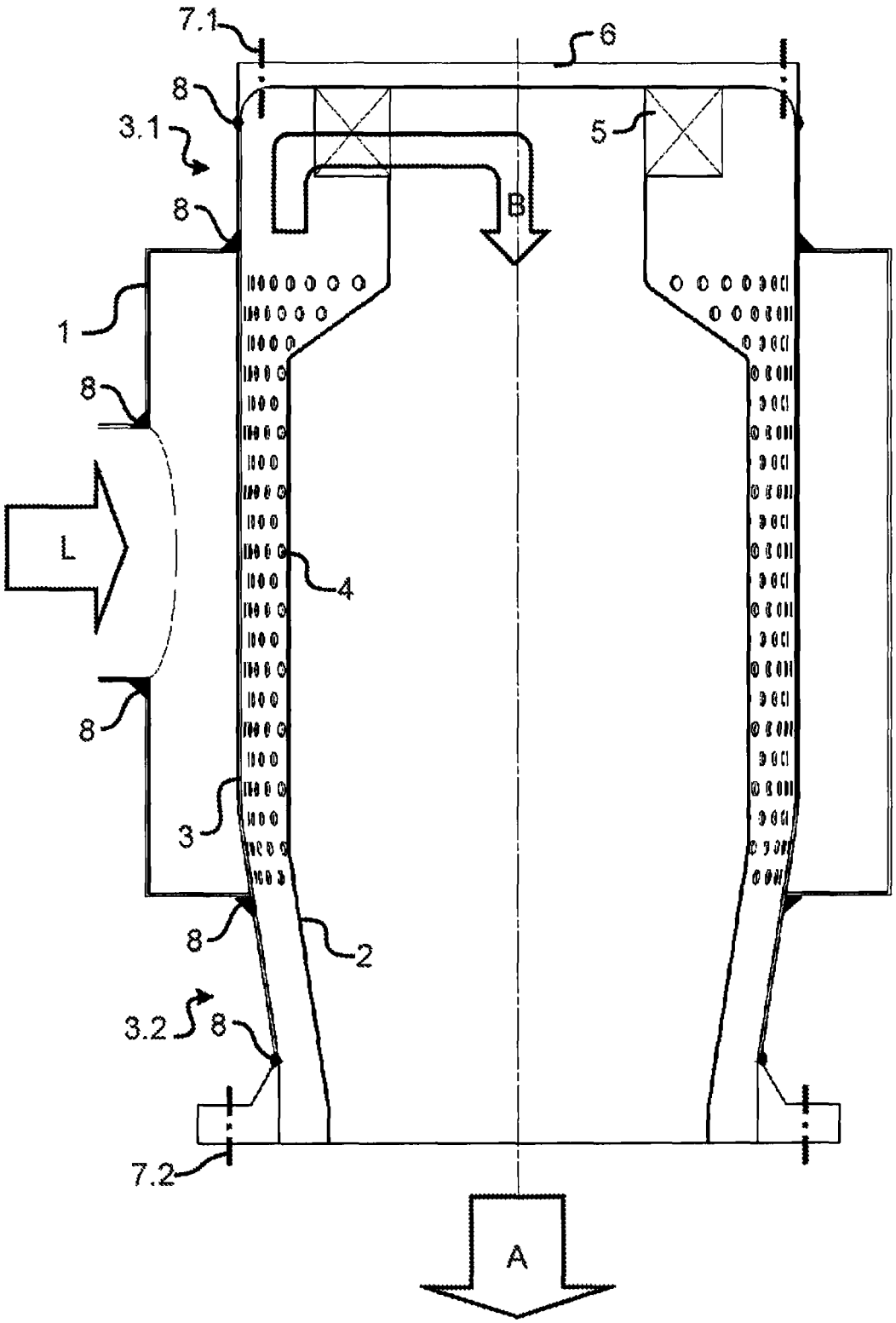
FIG. 2 is a partial axial and longitudinal cross-sectional view of a gas turbine combustion chamber according to an embodiment of the present invention.

FIG. 2 shows a gas turbine combustion chamber according to an embodiment of the present invention in axial and longitudinal section for replacing the combustion chambers shown in FIG. 1.

Within the interior of the latter, a flame tube 2 defines a combustion chamber. A combustion air/fuel mixture B is fed to the flame tube 2 through a radial swirler 5, is burned substantially in a cylindrical primary combustion zone of the combustion chamber or flame tube interior, and the exhaust gas A is then fed to a turbine (not shown).

In order to cool the flame tube, particularly in the area of the primary combustion zone, it is surrounded by a cylindrical perforated plate 3 having cooling apertures 4. Compressed combustion air L impinges on the flame tube 2 from the outside through these cooling apertures 4 before flowing along the flame tube 2 to the swirler 5 by which it is swirled and mixed with fuel.

In order to supply the combustion air in its entirety to the cylindrical perforated plate in the area of the primary combustion zone, the outer housing 1 of the combustion chamber forms an annular chamber 1 which can be formed of multiple plate portions which are welded together.

The one-piece perforated plate 3 is fastened via welds 8 on one hand at both end faces to an annular plate 6 of the swirler 5 and to a flange, respectively, for fastening the outer combustion chamber to a turbine housing (not shown) and, on the other hand, to the annular chamber 1 so that both of its end face areas 3.1, 3.2 form integral parts of the outer housing. In a modification, not shown, the perforated plate is formed axially of multiple parts with a center part which has cooling apertures 4 and is welded at the ends to the annular chamber 1 and edge strips 3.1, 3.2 of the perforated plate, respectively.

The plate 6 of the swirler 5 and the flange to which the perforated plate 3 is welded, the perforated plate 3 in this instance forming a part of the outer housing, are connected to a cover and the turbine housing (not shown), respectively, by screw connections 7.1, 7.2.

Particularly axial forces which are exerted at a high pressure level on the outer housing by the compressed combustion air L in the annular chamber 1 are partially absorbed and transmitted by the perforated plate in that the perforated plate 3 is incorporated, according to the invention, as support in the housing structure. Due to the fact that the cylindrical perforated plate 3 is connected annularly on both sides in the annular chamber 1 enclosing it, this annular chamber 1 is also strengthened and stiffened in radial direction.

Because the perforated plate 3 is constructed for transmitting loads of the housing 1 and, to this end, is fastened at its end faces 3.1, 3.2 to the housing, it can strengthen the housing in addition to its function of directing combustion air L to the flame tube 2 for cooling and guiding combustion air L to the swirler 5. Therefore, the housing can be constructed without ribs to a great extent and, accordingly, so as to be lighter at least in the area that is strengthened by the connected perforated plate.

Due to the fact that the perforated plate 3 and housing 1 have substantially identical wall thickness, the perforated plate can also directly form the outer housing in an advantageous manner, particularly in areas 3.1, 3.2 under less load, which advantageously makes the construction of the combustion chambers more compact and more favorable in technical respects pertaining to manufacture. Due to the fact that the perforated plate delimits the annular chamber radially from the inner side and subsequently defines the combustion air supply to the swirler in areas 3.1, 3.2 as outer housing, the totality of combustion air is used to cool the flame tube in a structurally advantageous manner. At the same time, because the annular chamber 1 is fitted on the outer side to the perforated plate 3 which projects beyond it axially, this perforated plate, whose front edge areas 3.1, 3.2 function as part of the outer housing, is integrated in a structurally advantageous manner.

The invention is not limited by the embodiments described above which are presented as examples only but can be modified in various ways within the scope of protection defined by the appended patent claims.

The invention claimed is:

1. A gas turbine combustion chamber comprising:

an outer housing portion (1);

a flame tube (2) disposed within said outer housing portion;

a perforated plate (3) at least partially surrounding said flame tube (2) and having an upper end face and a lower end face, each end face being fastened, at a respective fastening point, to a respective end of said outer housing portion, said perforated plate having cooling apertures (4) at least in a primary combustion area of said flame tube for impingement cooling of the flame tube (2); and a radial swirler (5) having an end plate (6), one of said end faces of said perforated plate being fastened to said end plate (6), wherein said outer housing portion and said perforated plate (3) define an annular chamber therebetween configured to impinge combustion air (L) on said perforated plate (3), the annular chamber (1) being further defined by a distance between the respective fastening points, and wherein the outer housing portion, the perforated plate (3), the respective fastening points, the end plate (6) and the radial swirler (5) are configured to cooperate with one another such that all of the combustion air is used initially to cool the flame tube (2) and then flows through the radial swirler.

2. The gas turbine combustion chamber according to claim 1, wherein said perforated plate (3) is constructed to transmit loads of the outer housing portion (1).

3. The gas turbine combustion chamber according to claim 1, wherein said outer housing portion (1) comprises one or more parts.

4. The gas turbine combustion chamber according to claim 1, wherein at least one of said end faces of said perforated plate is nondetachably fastened to said outer housing portion.

5. The gas turbine combustion chamber according to claim 4, wherein said at least one end face is nondetachably fastened by welding.

6. The gas turbine combustion chamber according to claim 1, wherein said perforated plate (3) is formed of one or more parts.

7. The gas turbine combustion chamber according to claim 1, wherein at least one corresponding area of said outer housing portion and of said perforated plate has substantially the same wall thickness.

8. The gas turbine combustion chamber according to claim 1, wherein said perforated plate (3) is shaped substantially as a right circular cylinder.

9. A gas turbine comprising at least one gas turbine combustion chamber according to claim 1.

10. The gas turbine according to claim 9, further comprising one of a cover and a base housing and wherein said gas turbine combustion chamber comprises screw connections for connecting said gas turbine combustion chamber to one of said cover and said base housing.

11. The gas turbine combustion chamber of claim 1, wherein at least one of said end faces of said perforated plate is fastened to said outer housing portion by one selected from the group consisting of gluing, press-fitting and riveting.

* * * * *